United States Patent [19]

Pritchard et al.

[11] Patent Number: 4,605,310

[45] Date of Patent: Aug. 12, 1986

[54] AUTOMATED SIZING SYSTEM CONTROLLING USING A RADIO TRANSMITTER LEVEL CONTROL

[75] Inventors: Frederick D. Pritchard, Clarksville; John E. Pittard, Halifax, both of Va.

[73] Assignee: Burlington Industries, Inc., Greensboro, N.C.

[21] Appl. No.: 699,473

[22] Filed: Feb. 8, 1985

Related U.S. Application Data

[62] Division of Ser. No. 491,274, May 4, 1983, Pat. No. 4,514,092.

[51] Int. Cl.[4] ..... B01F 15/02

[52] U.S. Cl. ..... 366/142

[58] Field of Search ..... 73/304 R, 304 L, 427, 73/428, 429, DIG. 5; 222/318, 64–69, 144.5; 366/132, 134, 136, 137, 142, 148, 153, 154, 159, 191, 192, 336, 337, 140, 144, 145, 152, 177, 182, 183, 338, 339, 340, 348; 118/688, 693

[56] References Cited

U.S. PATENT DOCUMENTS

| | | | |
|---|---|---|---|
| 2,623,449 | 12/1952 | Losee | 366/140 |
| 3,195,865 | 7/1965 | Harder . | |
| 3,239,197 | 3/1966 | Tollar . | |
| 3,394,924 | 7/1968 | Harder . | |
| 3,404,869 | 10/1968 | Harder . | |
| 3,425,668 | 2/1969 | Koenig et al. | 366/142 |
| 3,785,620 | 1/1974 | Huber . | |
| 3,871,624 | 3/1975 | Huber et al. . | |
| 4,139,123 | 2/1979 | Castillo | 222/318 |
| 4,362,033 | 12/1982 | Young | 366/142 |
| 4,483,463 | 11/1984 | Buschmann | 73/304 C |

OTHER PUBLICATIONS

Textile Industries, Nov. 1980, Staff Report, "Microprocessor QC Comes to Textiles", pp. 66, 68, 70 & 71.

Textile Journal-Australia, Feb./Mar. 1981, "Squeeze Size Box, Heavy Duty Beaming Machine by West Point", p. 22.

"Kasitrol" brochure Keystone International, Inc., Melliand Textilberichte (English Edition), Nov. 1980, Seydel, Computer-Controlled Sizing; pp. 1424–1428.

Textile Chemist and Colorist, Jul. 1981, vol. 13, No. 7, pp. 156–159.

*Primary Examiner*—Philip R. Coe

*Attorney, Agent, or Firm*—Nixon & Vanderhye

[57] ABSTRACT

A size application system and method utilize a plurality of size boxes associated with one or more slashers. A number of size formulation components are mixed and heated at atmospheric pressure to produce a size formulation having a predetermined composition and temperature. The size formulation is pumped in a closed loop past each of the size boxes. The size level in each size box is sensed utilizing a radio transmitter level control in each size box, which utilizes radio waves to sense the level of size in the box. In response to the sensing of the size level by the radio transmitter level control, size formulation is withdrawn from the closed loop through controlled valves, and supplied to each size box having an amount of size therein below a predetermined desired level.

4 Claims, 7 Drawing Figures

Fig. 1.
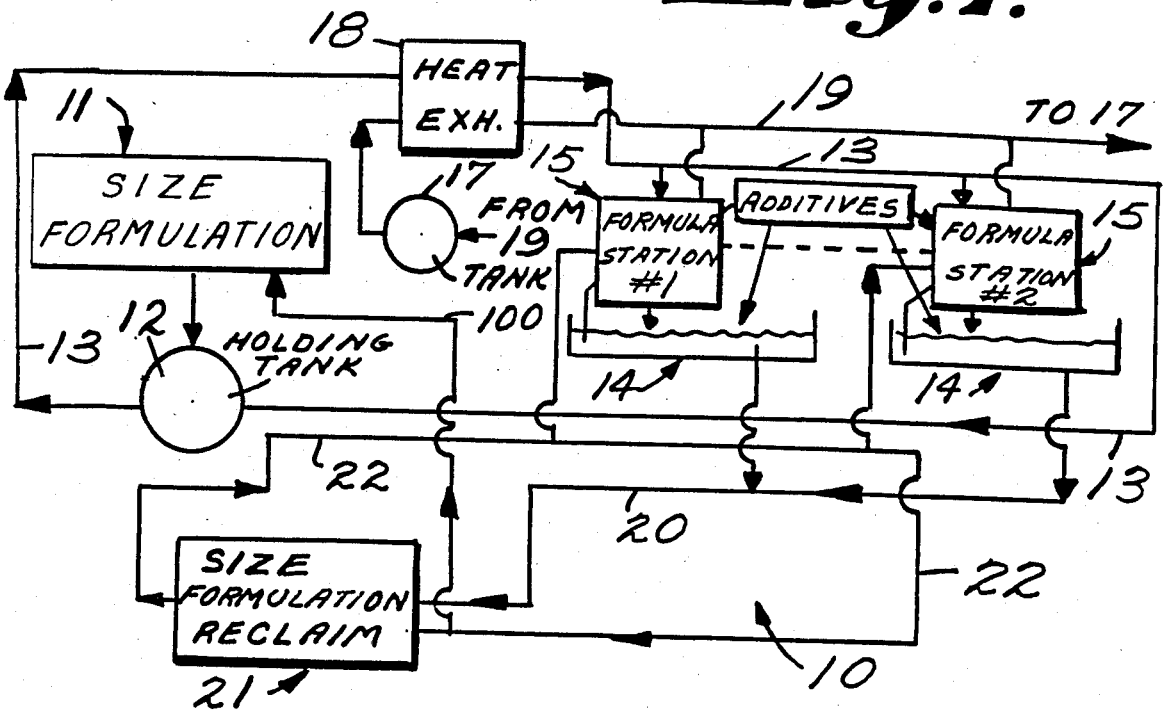
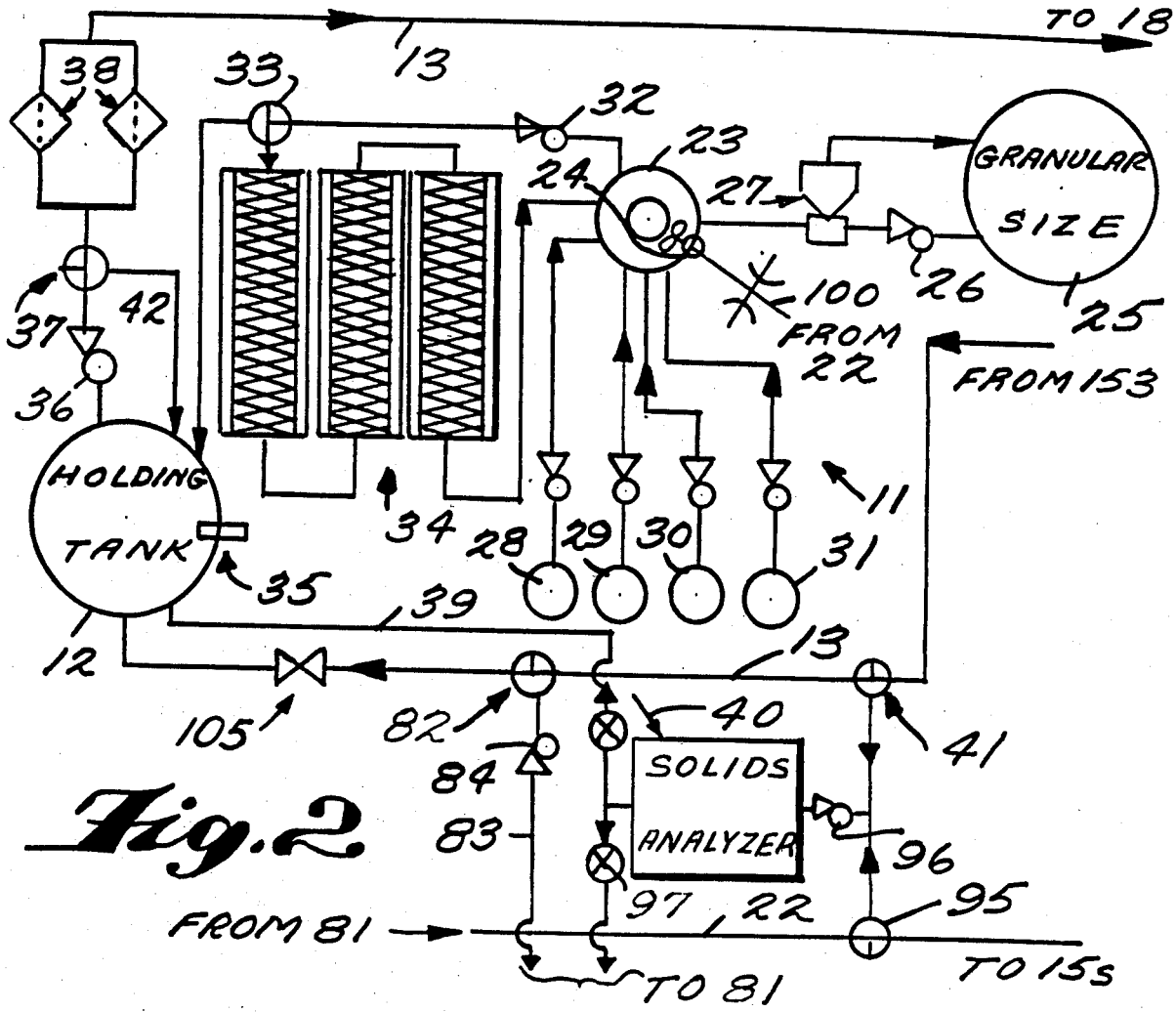
Fig. 2

AUTOMATED SIZING SYSTEM CONTROLLING USING A RADIO TRANSMITTER LEVEL CONTROL

CROSS REFERENCE TO RELATED APPLICATION

This application is a divisional of application Ser. No. 491,274 filed May 4, 1983, now U.S. Pat. No. 4,514,092.

BACKGROUND AND SUMMARY OF THE INVENTION

Conventional size formulation systems associated with slashers in textile processing plants have a number of drawbacks associated therewith. In typical systems a size formulation mixer and two storage tanks are required to supply the size box associated with each slasher. Whenever a run through a slasher with a given size formulation was completed, the size formulation remaining in the size boxes was sewered, and there was substantial down time of the slasher while a new batch was laboriously mixed. Precise control of the size formulation was also difficult, wide temperature variations at the point of size formula application resulted due to variations in the amounts of diluent used, etc., and in general there was a great deal of waste of energy, labor, and material.

According to the present invention a method and apparatus are provided which overcome the drawbacks associated with prior art size formulation and supply techniques and systems. According to the present invention size formulation and supply can be practiced with predictability and repeatability with minimum slasher down time, minimum labor input, and minimum waste of energy and material. Additionally the apparatus according to the invention substantially reduces the floor space required for the size formulation and supply functions, with attendant advantages. The composition and temperature of the size formulation is precisely and reliably controllable, and all formulation and supply functions can be readily controlled by a single computer control means.

According to the present invention the mixing and heating of a number of size formulation components to produce a size formulation having a predetermined composition and temperature is greatly simplified. A single mixing tank can supply the size formulation for all the size boxes associated with a plurality of slashers. A granular size component, such as PVA, is supplied through a closed pneumatic loop to a weigh hopper, which periodically discharges the size component into the mixing tank. Other size components such as water, defoamer, and wax are also added to the tank, and heating is accomplished by pumping the formulation from the tank through an interfacial surface generation (ISG) heat exchanger, and then back to the tank. After mixing and heating, the size formulation is dumped into a holding tank, the holding tank being disposed in a closed loop which continuously circulates the size formulation past each of the size boxes.

A plurality of formula stations are provided adjacent the size boxes. At least one formula station is operatively associated with each size box. At the formula stations, further additional size formulation components are added to the size formulation and mixed therewith to provide a homogeneous altered size formulation prior to passage of the size formulation into a size box. Tints, density control fluids, reclaimed size, diluent, and other components may be added at the formula stations, and mixing is accomplished using an ISG mixer. Valve and pump means within the formula station are activated by a radio transmitter level control associated with each size box so that the appropriate level of size formulation is always provided in each size box.

As the size formulation circulates in the closed loop, the temperature thereof is reduced from the mixing temperature (typically about 195° F.) to the use temperature (typically about 150°-160° F.). This is accomplished by passing it through a recovery heat exchanger in heat-exchanging relationship with diluent (e.g. water) that is also circulated through the heat exchanger. The diluent is then supplied to the formula station to be mixed with the size formulation where desired.

When the size formulation in the size box is to be replaced, it is drained from the size box and circulated into a reclamation system rather than being sewered. In the reclamation system it can be filtered and/or passed through ion exchange media, and/or through sorption media, and the solids content thereof can be analyzed. After all undesirable components are removed therefrom it can be ultimately returned to the size boxes for reuse. This can be done either by passing it to the virgin size mixing tank, or circulating it in a closed loop past and to the formula stations.

It is the primary object of the present invention to provide a method and system for efficiently and effectively supplying size to size boxes associated with slashers. This and other objects of the invention will become clear from an inspection of the detailed description of the invention, and from the appended claims.

BRIEF DESCRIPTION OF THE DRAWINGS

FIG. 1 is a diagrammatic view of major components of an exemplary size system according to the present invention;

FIG. 2 is a detailed diagrammatic view of the mixing, heating, solids analysis, and circulating components of the system of FIG. 1;

DETAILED DESCRIPTION OF THE DRAWINGS

Figure 3:
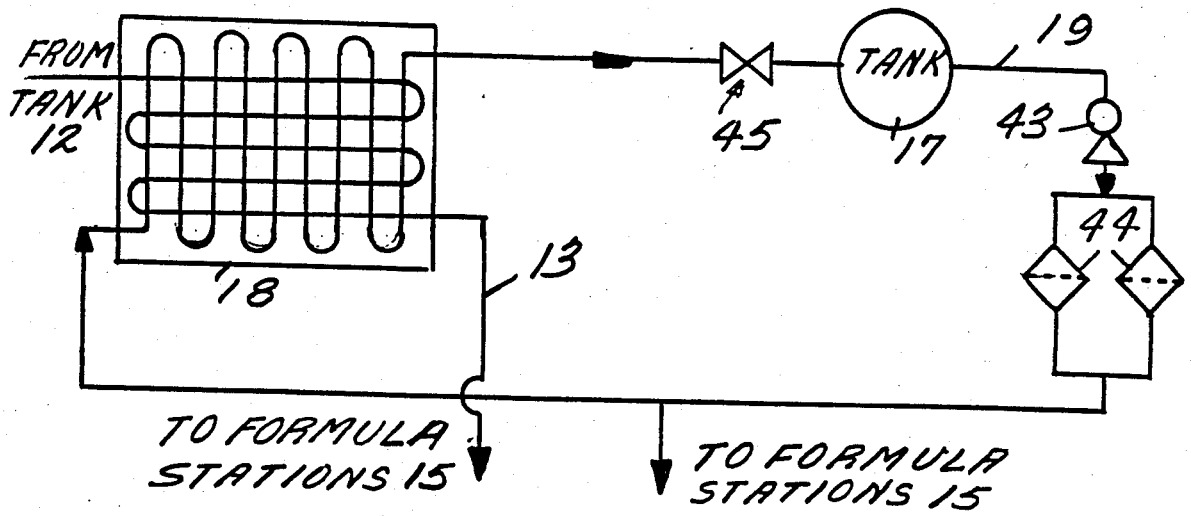
FIG. 3 is a detailed schematic of the recovery heat exchanger, diluent loop, and related components of the system of FIG. 1.

An exemplary size formulation and supply system according to the present invention is shown generally by reference numeral 10 in FIG. 1. The basic, virgin size formulation is prepared at station 11. At station 11 basic size formulation ingredients such as water, defoamer, size (e.g. polyvinyl alcohol (PVA), and wax) are heated to an appropriate mixing temperature (e.g. about 195° F.), and mixed together. Periodically the prepared basic size formulation is deposited in a holding tank 12 which, with conduit 13 and other components, comprises a closed circulation loop for continuously circulating the basic size formulation past a plurality of conventional size boxes—shown schematically by reference numeral 14—associated with a plurality of conventional slashers.

the term "size box" as used in the present specification and claims encompasses conventional troughs for application of liquid size formulations, and apparatus for foamed sizing applications.

Associated adjacent, and in operative communication with, the size boxes 14 are formula stations 15. At the formula stations additives, such as tints, diluents, gas (for foaming), reclaimed size, etc., are integrally mixed with the basic size formulation flowing in loop 13 and added to the size box 14 associated with a formula station 15 whenever level control means 16 of the size box senses the need to replenish the size formulation in the size box 14. A closed diluent circulation loop including holding tank 17, recovery heat exchanger 18, and conduit 19, supplies diluent to the formula stations 15 as needed. The heat exchanger 18 causes the size formulation in conduit 13 to give up some of its heat to the diluent, to thereby reduce the temperature of the size formulation in conduit 13 to the use temperature thereof (e.g. 150°–160° F.) in the size boxes 14.

When a given run on a slasher has been completed and the size formulation in the size boxes 14 associated with that slasher is to be changed, the size is drained from the boxes 14 through drain line 20, and passed to a size formula reclamation station 21 at which unwanted components of the size formulation are removed. The reclaimed size formulation can either be passed to the virgin size formulation station 11, and mixed with virgin size formulation, or it can be circulated through line 22 past and to the formula stations 15.

The size formulation station 11 and the closed circulatory loop components associated with the tank 12 and conduit 13 are shown in greater detail in FIG. 2. According to the present invention it is possible to minimize the floor space associated with the size formulation components since it is only necessary to provide one mixing tank 23 to mix the size formulation for all of the size boxes 14 associated with a plurality of slashers. The tank 23 includes a conventional mechanical mixer 24, and it is supplied with a granular size component (e.g. PVA) from storage tank 25.

A pump 26 continuously circulates granular size from storage tank 25 in a pneumatic line to a weigh hopper 27, and back to the storage tank 25. When the size component weighed out by the weigh hopper 27 is ready to be added to the tank 23, a butterfly valve (not shown) at the bottom of the weigh hopper 27 opens up, dumping the contents thereof into the tank 23. The appropriate amount of water is added to tank 23 from source 28, defoamer is added from source 29, wax is added from source 30, and any other desired components can be added from additional sources (e.g. 31) to provide the desired composition. A typical composition would be about 3036 pounds of water, 2 pounds defoamer, 278 pounds PVA, and 20 pounds wax, providing a size formulation having about a nine percent solids content.

As the defoamer is being added to tank 23 from source 29, the mixer 24 is started, pump 32 is activated, and valve 33 is actuated so that size formulation from tank 23 circulates through interfacial surface generation (ISG) heat exchanger 34. The ISG heat exchanger is supplied with heat from a steam source (not shown), and by utilizing the ISG heat exchanger 34 it is possible to heat the size formulation in substantially less time, and with more efficient steam usage, than is possible conventionally. Typically the heat exchanger is constructed appropriate to the need from the proper number of commercially available ISG mixers such as the SMXL static mixing elements manufactured by Koch Engineering Co., Inc. The contents are heated to an appropriate mixing temperature (e.g. about 195° F.) and are retained at that temperature a programmed amount of time (e.g. 20 minutes) in order to insure completely homogeneous distribution of all of the size formulation components. At the end of the cooking time the valve 33 is activated to divert the size formulation to the holding tank 12, all of the size formulation from tank 23 being pumped out by pump 32 to the holding tank 12. A level control 35 preferably is provided associated with the tank 12 to initiate the entire formulation sequence when the level in the tank 12 drops below the predetermined minimum.

The other components besides tank 12 and conduit 13 in the size formulation closed circulatory loop include pump 36, valve means 37, back pressure valve 105, and filters 38. Additionally, size formulation can be withdrawn from the line through valve 41 to go to a solids analyzer station 40 wherein the appropriate solids content thereof is determined, and then the formulation is returned to the tank 12 through line 39. The amount of granular size from tank 25 added during the mixing sequence can be made responsive to the analysis provided at station 40 in order to provide the size formulation with a desired consistency (e.g. nine percent solids).

If it is necessary to put parts or all of the basic closed circulatory loop out of use, the basic size formulation in tank 12 may be circulated by pump 36 through valve 37 and conduit 42 back to the tank 12. Additionally, in case the temperature of the size formulation drops too low (e.g. below 150° F.), steam may be added directly to the tank 12 to reheat the size formulation.

In order to insure precise control of the characteristics of the size formulation, including its temperature, it is desirable to specifically reduce its temperature from the cooking temperature to the use temperature utilizing the recovery heat exchanger 18 (see FIG. 3 in particular). In order that the heat not be wasted, diluent (e.g. water) is circulated in heat-transfer relationship with the size formulation flowing through heat exchanger 18 by the system illustrated most clearly in FIG. 3. That system includes tank 17, conduit 19, pump 43, filters 44, and valve 45. The heated diluent, like the circulating basic size formulation, is ultimately supplied to the formula stations 15 and utilized as necessary. Since the diluent has been heated to substantially the use temperature (to which the size formulation has been cooled, e.g. 150°–160° F.) it is assured that the size formulation is at the appropriate temperature when supplied to the size boxes 14.

Figure 4:
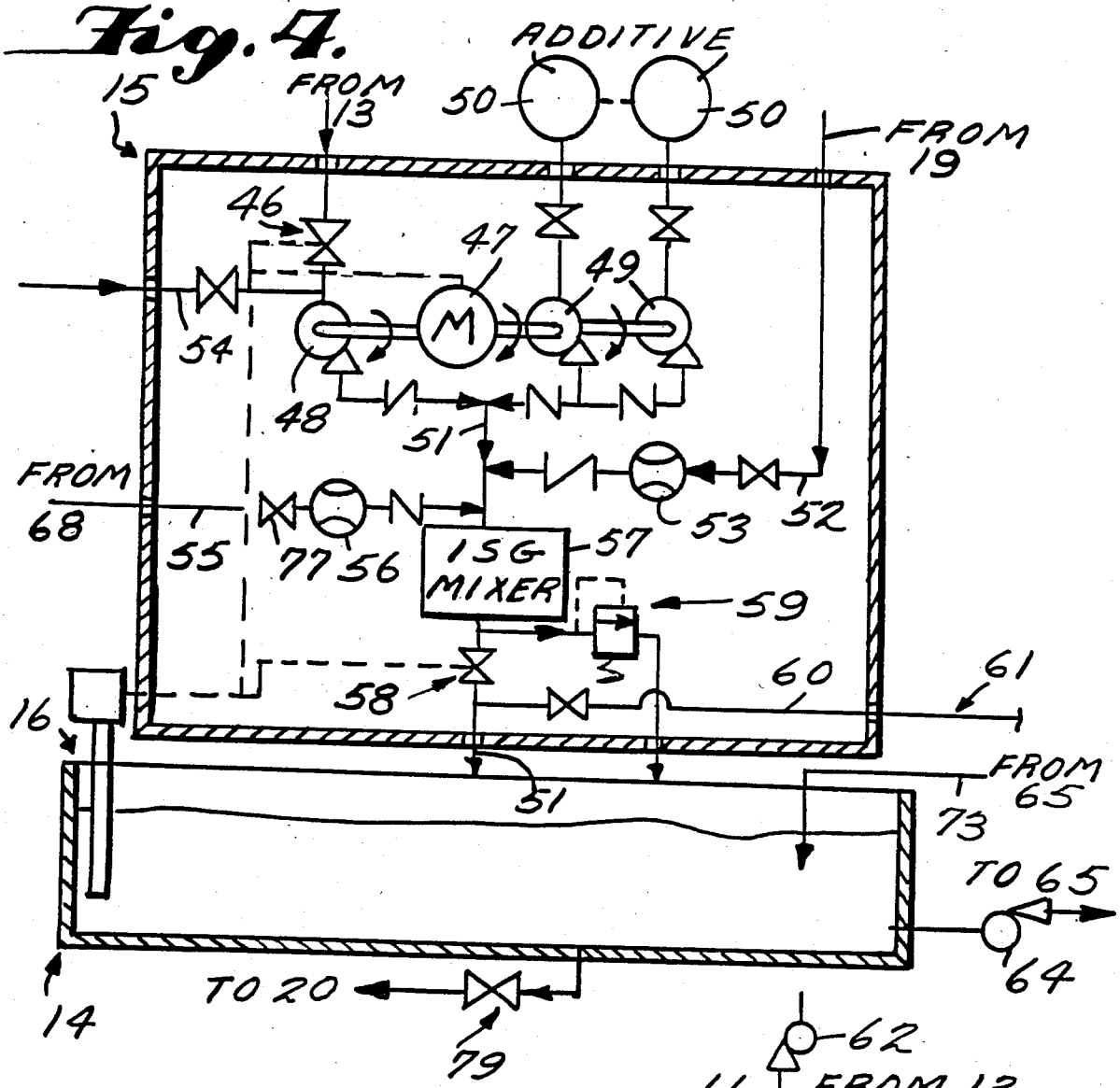
FIG. 4 is a detailed schematic of an exemplary formula station and size box of the system of FIG. 1.

A typical formula station 15 and associated size box 14 are illustrated most clearly in FIG. 4. All of the components illustrated schematically in FIG. 4 within the double line to which reference numeral 15 is directed can be provided within a single casing mounted adjacent the size box 14. Typically a single formula station 15 may be provided for each size box 14, although one formula station 15 may be provided for a plurality of size boxes 14 as long as the size boxes 14 will be running the same size formulation, or if appropriate valving means are provided associated with the discharge from the formula station to the various size boxes.

The basic size formulation is supplied to valve 46 in formula station 15, the valve 46 being controlled in response to the level in size box 14 sensed by the automatic level sensing means 16. Preferably the automatic level sensing means 16 comprises a radio transmitter level sensing mechanism, which has many desirable characteristics (including adjustable sensitivity) for that particular use. A typical commercially available level sensing means 16 is manufactured by ASI-Keystone, Inc.—Div. Keystone Inter., Inc. and sold under the tradename Kasitrol.

A small electric motor 47 within station 15 powers pump 48 for supplying the basic size formulation, as well as pumps 49 which pump additives from additive sources 50 located adjacent the formula station 15. Typical additives would be tints, and the like. The additives and basic size formula both pass to a common conduit 51, and diluent may be added to the conduit 51 from line 52 after passing through meter 53. Reclaimed size may also be added through line 54. Gas from the gas supply source (68) illustrated in FIG. 5 (to be hereinafter described) may also be added to line 51 through line 55 and meter 56 if foamed sizing is practiced. The unidirectional flow of additives from conduit lines 13, 52, 54, 55 and sources 50 are guaranteed by the insertion of appropriate check values denoted by the symbol (-N-) in FIG. 4.

A key to being able to provide practical size formulation stations 15 is the ISG mixer 57 to which conduit 51 leads. This mixer, which is of the type more specifically shown in U.S. Pat. Nos. 3,785,620 and 3,871,624, is capable of completely mixing a wide variety of components in a very short space (e.g. several inches of linear space). Additionally, the ISG concept is described principally in the U.S. Pat. Nos. 3,195,865, 3,239,197, 3,394,924, and 3,404,869. After being mixed by mixer 57, when the level control means 16 calls for and actuates the valve 58, the basic size formulation, modified as desired by additives from sources 50, diluent from line 52, reclaimed size from line 54, and/or gas from line 55, is passed through conduit 51 out of the formula station 15 directly into size box 14.

A pressure relief valve 59 may be associated with the conduit 51 downstream of the mixer 57 for safety purposes, and the sampling line 60 (with connection 61 exterior of the station 15) may be provided to allow sampling of the size formulation being supplied to the size box 14 to insure that it has the desired composition.

Gas extended formulas during application exposures to warps at the size boxes may become altered either in the amount of diluent or gas present. In these cases, in order to reuse the extended formulations, it is necessary to re-extend the used formula with gas to bring it back to use densities or to compensate for excessive amounts of liquid diluent. Density control, and gas supply means, utilizable to effect such purposes are illustrated schematically in FIG. 5.

Figure 5:
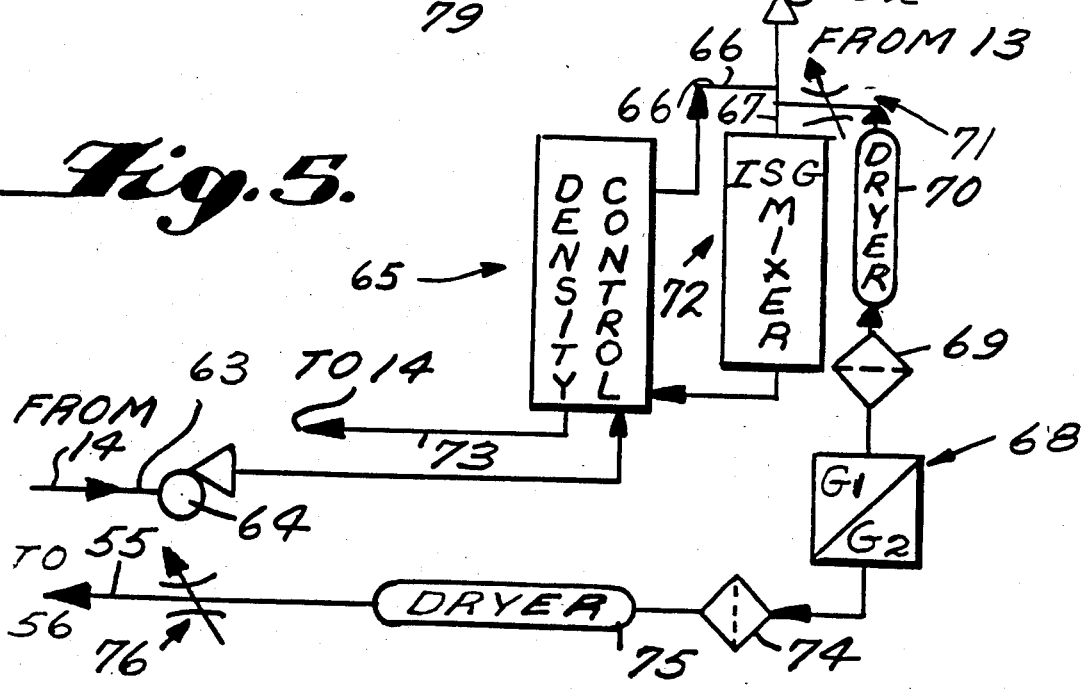
FIG. 5 is a detailed schematic of exemplary size box density control and gas supply components of the system of FIG. 1.

In the sub-system illustrated in FIG. 5, the size formulation in one or more size boxes 14 is pumped through line 63 by pump 64 (see FIGS. 4 and 5) to a conventional density control apparatus 65 which determines the density of the size formulation, and then passes it through conduit 66 to be added to basic size formulation pumped from conduit 13 by pump 62 into branch conduit 67, and any necessary amount of gas from source 68 to bring the density to the desired level. Gas under pressure from source 68 passes through filter 69, dryer 70, and flow control valve 71 to the conduit 67. The size formulation withdrawn from tank 14, the basic size formulation from conduit 13, and any necessary amount of gas from source 68 are mixed together in ISG mixer 72, and then returned to the density control mechanism 65 for re-testing, and then ultimately passed through conduit 73 back to size box 14. Basic size formulation from conduit 13 is added to the size formulation withdrawn from size box 14 only if there is excess liquid diluent, and gas from source 68 is added only if density control is necessary.

In order to reduce energy consumption in the drying of size and substrates, gas can be used to extend the size formulation dispensed from the stations 15. Formulas extended in this manner are foams, thus the invention is applicable to the practice of foam sizing. Foam sizing is desirable since it is more energy efficient (gas has a lower specific heat than liquid), and while foam sizing has been used to a limited extent heretofore, it has not achieved widespread use because tight controls of process parameters and formulation conditions are necessary. However, such tight controls can easily be implemented in the practice of the present invention.

In order to practice foam sizing, gas is supplied from source 68 through filter 74, dryer 75, and regulating valve 76 through line 55, and ultimately through meter 56 to mixer 57 in formula station 15 (see FIG. 4). To start the flow of gas one need only actuate valve 77 in line 55, the flow control valve 76—which is controlled by the meter 56—providing the appropriate amounts of gas to provide carefully controlled foamed sizing.

Figure 6:
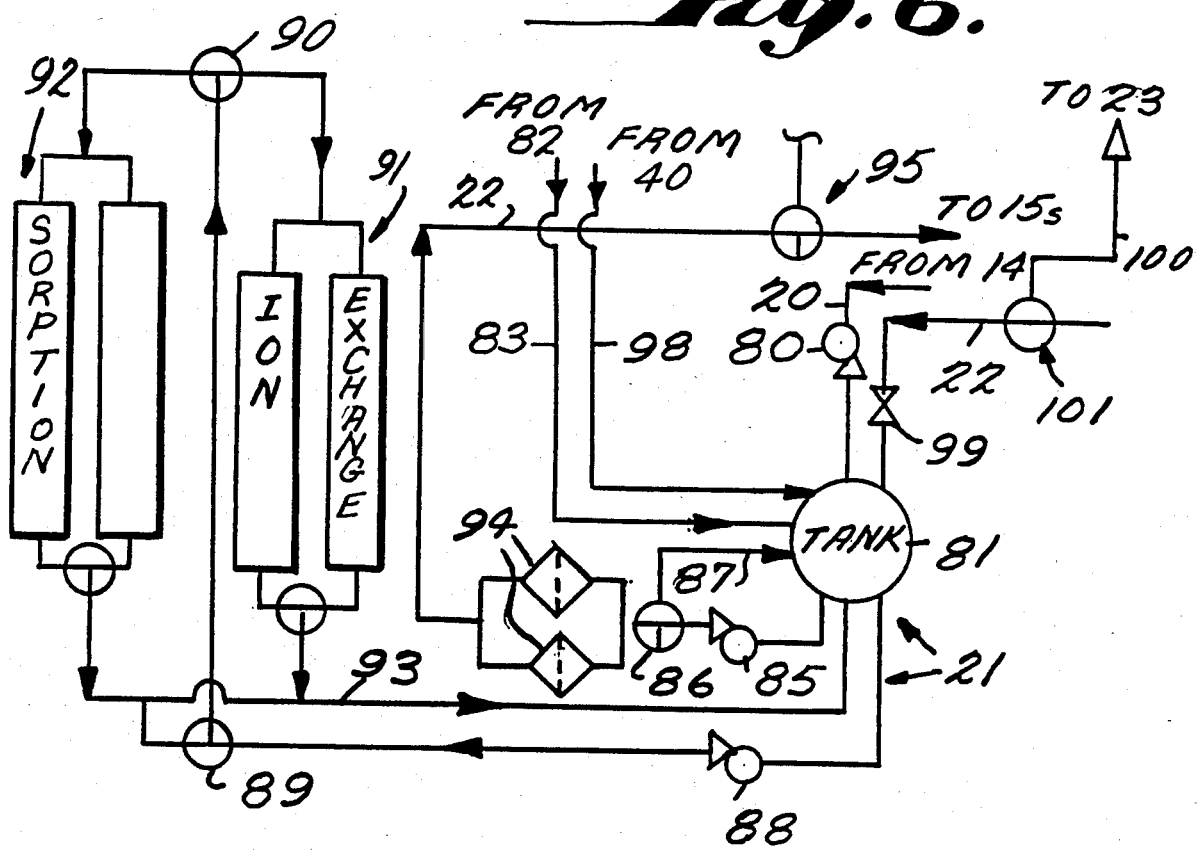
FIG. 6 is a detailed diagrammatic view of exemplary size reclamation components of the system of FIG. 1.

Associated with each size box 14 (see FIG. 4) is a drain valve 79, which is operatively connected to drain conduit 20. As illustrated in FIG. 6, pump 80 in drain conduit 20 pumps a size formulation from boxes 14 to size formulation reclaiming system 21 rather than sewering the size formulation.

Size formulation reclaim system 21 includes storage and supply tank 81. The contents of the tank 81 are maintained at a pre-programmed temperature (e.g. 150° F.), and this may be accomplished by adding steam directly to the tank 81.

If it is desirable to increase the solids level of the size formulation in tank 81, the valve 82 (see FIG. 2) in line 83, and the metering pump 84, are activated to pump basic size formulation from conduit 13 directly to the tank 81. The contents of tank 81 are then thoroughly mixed by being withdrawn from tank 81 by pump 85 and pumped through valve 86 and line 87 back to the tank 81.

Oftentimes the reclaimed size in tank 81 will have undesirable components, such as yarn, dyeing or tinting residues such as coning oils, dyestuff bleed-offs, etc. These may be removed by activating pump 88 to pass the reclaimed size formulation through valves 89 and 90 and then through treatment stations 91 and/or 92. Station 91 contains ion exchange media, while station 92 contains selected absorbents, adsorbents, or combinations of the same. After treatment the reclaimed size is returned through line 93 to tank 81.

After removing undesirable components, the size in tank 81 is pumped by pump 85 through valve 86 and filters 94 to line 22, and ultimately to the size formulation stations 15. Alternatively, the size formulation in line 22 may pass through valve 95 to the solids analyzer station 40 under the influence of pump 96. After analysis it is returned through valve 97 in line 98 to the tank 81

(see FIGS. 2 and 6). When passing to the stations 15, the reclaimed size circulates in a closed loop defined by conduit 22, and after circulating past the stations 15 it returns through back pressure valve 99 to the tank 81.

Valves 41 and 95 associated with the conduits 13 and 22 can be used to continuously withdraw only a small amount of the size formulation flowing in conduits 13, 22 and divert it to the solids analyzer station 40, rather than diverting the entire flow of size formulation therethrough. Valve 82 may also direct only a portion of the size flowing in loop 13 to line 83.

If desired, reclaimed size flowing in line 22 may be diverted to line 100 by valve 101, and ultimately passed to mixing tank 23 (see FIGS. 2 and 6).

Figure 7:
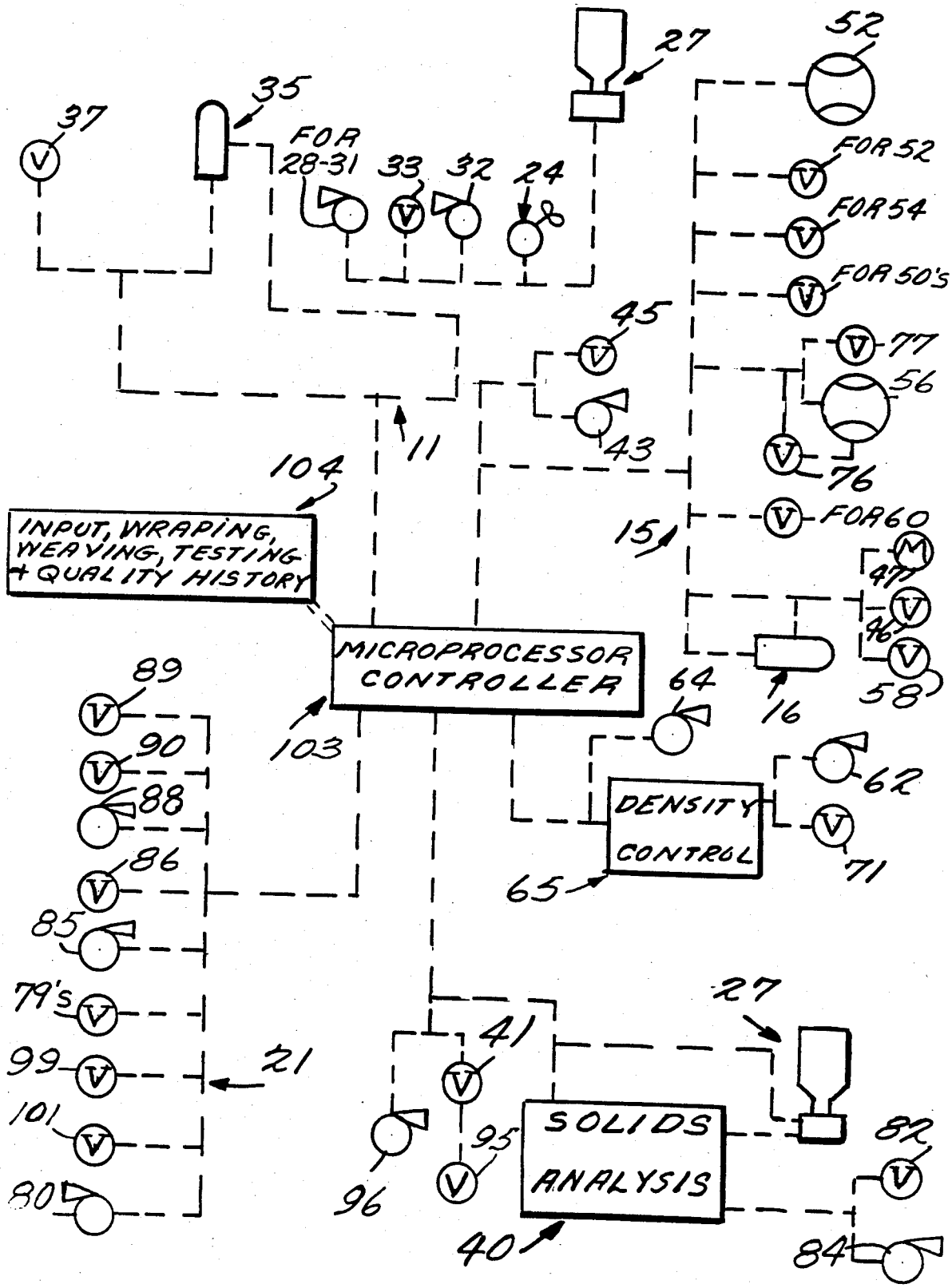
FIG. 7 is a control schematic illustrating various exemplary control interconnections between the components of the system of FIG. 1.

A control schematic illustrating the control interrelationship between components is provided in FIG. 7. The system according to the present invention lends itself readily to control by a computer control means, such as microprocessor controller 103. The microprocessor controller 103 is provided input from station 104. The input can be information from warping, weaving, and testing the quality history of yarn previously sized, and/or conditions to be expected in the future.

OPERATION

The qualities of size to be utilized in the size boxes 14 of each of a plurality of slashers is determined, and that information is fed into microprocessor controller 103. The microprocessor 103 controls the valves for the additives 50, the valve for diluent line 52, and the valve for reclaimed size line 54 in each of the stations 15 depending upon the desired conditions in the size box 14 associated with each station 15. If the sizing is to be foamed, the microprocessor 103 also controls the valve 77 and meter 56.

Basic size formulation is mixed at station 11 by dumping a predetermined amount of granular size from weigh hopper 27 into tank 23 after the addition of the components from sources 28 through 31 (e.g. water, defoamer, wax, etc.). The basic size formulation is circulated through an ISG heat exchanger 34, and after appropriate mixing and holding at mixing temperature (e.g. 195° F.) for the predetermined length of time, the basic size formulation is passed through valve 33 to holding tank 12. From holding tank 12 it is continuously circulated by pump 36 in conduit 13 past the size formulation stations 15, through back pressure valve 105, and back to tank 12.

At each size formulation station 15, when the level control means 16 senses the necessity to supply additional size formulation to the size box 14 with which it is associated, the motor 47 and the valves 46, 58, 77, etc. are activated. The appropriate additive, e.g. tint, from one or more selected sources 50 is supplied by pump(s) 49 to conduit 51 to mix with reclaimed and/or virgin size formulation supplied by pump 48, with diluent added from line 52 as necessary, and with air added from line 55 if foam sizing is to be practiced. All the components are mixed in ISG mixer 57, passed through valve 58 and into the size box 14. Once the predetermined level has been re-established, the level control 16 cuts off the motor 47, valves 58, 46, etc.

The solids content of the basic size formulation in conduit 13 is periodically evaluated by actuating valve 41 and pump 96 to send a portion of the size formulation flowing through conduit 13 to the solids analyzer station 40. After testing the size is returned to holding tank 12 through line 39, and the information regarding the solids content of the size is utilized by microprocessor 103 to control the weigh hopper 27, and thus the amount of size component of the size formulation added during mixing to achieve the predetermined desired solids concentration (e.g. nine percent).

In order to insure appropriate density of the size formulation at the size boxes 14, pump 64 associated with each size box 14 periodically withdraws a portion of the size formulation in size box 14 and passes it to density control station 65. The density control station 65 activates pump 62 and gas flow control valve 71 as necessary to provide gas and/or virgin size to the withdrawn size formulation in line 66, and the components are then mixed in ISG mixer 72. The density thereof is then again determined in density control station 65, and then the size formulation, with appropriate density, is returned to the size box 14.

After a predetermined run utilizing a size box 14 associated with a particular slasher, the microprocessor 103 activates drain valve 79 to drain the size formulation from that size box 14, and then the valves associated with additives supplies 50, valve 77 and the valves associated lines 52, 54 are acted upon so as to provide another size formulation having the desired components, and that size formulation can immediately be added to the size box 14 so that there is essentially no slasher down time in order to change size formulations.

The size withdrawn through drain line 79 passes to size formula reclamation station 21, flowing under the influence of pump 80 into tank 81. The unwanted components of the size formulation (e.g. coning oils) are removed by activating pump 88 and valves 89, 90 to pass the size formulation through the treatment stations 91, 92, and then returned to the tank 81 through line 93. Then the size can be pumped by pump 85 through valve 86 and filters 94 into the circulatory loop defined by conduit 22 to pass past the formula stations 15 and to be utilized therein where desired.

The valve 95 and pump 96 are activated once the treated reclaimed size is passed into line 22 to pass a portion of the reclaimed size through solids analyzer station 40 to determine the solids content thereof. Should the solids content be insufficient, the valve 82 and pump 84 are activated to supply some virgin size to tank 81 through line 83. The virgin size, and reclaimed size, are mixed together by activating valve 86 so that size formulation circulated by pump 85 goes through line 87 directly back into tank 81. Once a desired solids concentration has been reached, the valve 86 is activated to again allow pumping of the size by pump 85 through filters 94 into line 22.

It will thus be seen that according to the present invention methods and systems are provided which effect the efficient precisely controllable formulation of size compositions with a minimum of floor space, a minimum waste of size formulation, a minimum waste of energy, and with maximum efficiency and controllability. Utilizing the systems and methods according to the present invention accuracies of 99.9 percent and precisions of 350 parts per million or less are attainable in formulating size compositions.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent systems and methods.

What is claimed is:

1. A method of providing size formulation to one or more of a plurality of size boxes associated with a plurality of slashers, comprising the steps of:

(a) mixing and heating a number of size formulation components to produce a size formulation having a predetermined composition and temperature;

(b) circulating the size formulation in a closed loop past each of the size boxes;

(c) sensing the size level in each size box utilizing a radio transmitter level control in each size box, which utilizes radio waves to sense the level; and (d) responsive to said sensing in step (c), withdrawing size formulation from said closed loop and supplying it to each size box having size therein below a predetermined level.

2. A method as recited in claim 1 wherein step (a) is practiced at atmospheric pressure, and wherein step (b) is practiced by pumping the size formulation.

3. A size application system comprising:

a plurality of size boxes associated with one or more slashers;

means for mixing and heating a number of size formulation components to produce a size formulation having a predetermined composition and temperature;

means for circulating the size formulation in a closed loop past each of said size boxes;

a radio transmitter level control system for sensing the amount of size in each size box; and valve means in a conduit extending between said closed loop and said size box, for withdrawing size formulation from said closed loop and supplying it to a size box in response to said radio transmitter level control system.

4. A size application system as recited in claim 3 wherein said mixing and heating means mixes and heats a component at atmospheric pressure, and wherein said circulating means comprises pump means.

* * * * *